US007780051B2

(12) United States Patent
Godshaw et al.

(10) Patent No.: US 7,780,051 B2
(45) Date of Patent: Aug. 24, 2010

(54) FRAMED SOFT SIDED CARRIER FOR TOOLS

(75) Inventors: Donald E. Godshaw, Evanston, IL (US); Andrezj M. Redzisz, Wheeling, IL (US)

(73) Assignee: Travel Caddy, Inc., Elk Grove Village, IL (US)

( * ) Notice: Subject to any disclaimer, the term of this patent is extended or adjusted under 35 U.S.C. 154(b) by 1141 days.

(21) Appl. No.: 11/044,894

(22) Filed: Jan. 27, 2005

(65) Prior Publication Data

US 2005/0189388 A1 Sep. 1, 2005

Related U.S. Application Data

(60) Continuation-in-part of application No. 10/430,717, filed on May 6, 2003, now Pat. No. 6,945,442, which is a division of application No. 09/838,908, filed on Apr. 20, 2001, now Pat. No. 6,571,998, which is a continuation-in-part of application No. 09/838,908, filed on Apr. 20, 2001, and a continuation-in-part of application No. 10/982,319, filed on Nov. 4, 2004, which is a continuation of application No. 10/393,125, filed on Mar. 20, 2003.

(60) Provisional application No. 60/365,966, filed on Mar. 20, 2002, provisional application No. 60/198,966, filed on Apr. 21, 2000.

(51) Int. Cl.
*A45F 3/02* (2006.01)

(52) U.S. Cl. ..... 224/607; 206/372

(58) Field of Classification Search ..... 224/581–583, 224/607, 610, 611, 653, 257, 678, 679, 681, 224/231, 236, 246, 904; 206/372, 373; 190/110, 190/127, 109, 111, 115–118; 383/12, 18, 383/84; 150/113
See application file for complete search history.

(56) References Cited

U.S. PATENT DOCUMENTS

| | | | | | |
|---|---|---|---|---|---|
| 1,597,092 | A * | 8/1926 | McTighe | ..... | 220/812 |
| 2,254,578 | A * | 9/1941 | O'Brien | ..... | 190/107 |
| 2,334,895 | A * | 11/1943 | Bracken | ..... | 190/111 |
| 2,437,405 | A * | 3/1948 | Robinson | ..... | 294/137 |
| 3,001,566 | A * | 9/1961 | Lipsitz | ..... | 224/610 |
| 3,994,372 | A * | 11/1976 | Geller et al. | ..... | 190/107 |
| 5,160,001 | A * | 11/1992 | Marceau | ..... | 190/102 |
| 5,423,404 | A * | 6/1995 | Shaw | ..... | 190/102 |
| 5,699,886 | A * | 12/1997 | Latshaw | ..... | 190/108 |
| 6,126,003 | A * | 10/2000 | Brouard | ..... | 206/372 |
| 6,179,185 | B1 * | 1/2001 | Dancyger | ..... | 224/576 |
| 6,193,034 | B1 * | 2/2001 | Fournier | ..... | 190/107 |
| 6,223,870 | B1 * | 5/2001 | Godshaw | ..... | 190/107 |

(Continued)

*Primary Examiner*—Nathan J Newhouse
*Assistant Examiner*—Corey N Skurdal
(74) *Attorney, Agent, or Firm*—Fitch, Even, Tabin & Flannery

(57) ABSTRACT

A collapsible bag or container includes first and second major pockets separated by a connecting web into which a metal frame is removably inserted. Alternatively, a plastic or rigid board member is substituted for the metal frame. Loops and handles project through the web for attachment of a carrier strap or manual handle. Another embodiment includes rigid end panels connected by a rigid bottom panel and a rigid handle with a flexible interior dividing wall supported by straps attached to the rigid handle and by attachment to the end panels and bottom panel.

4 Claims, 14 Drawing Sheets

U.S. PATENT DOCUMENTS 6,334,519 B1 * 1/2002 Tong ..... 190/107
6,823,992 B2 * 11/2004 Redzisz ..... 206/373
6,883,654 B2 * 4/2005 Godshaw et al. ..... 190/115
6,945,546 B2 * 9/2005 Guirlinger ..... 280/47.19
7,090,399 B2 * 8/2006 Godshaw et al. ..... 383/119
7,150,345 B2 * 12/2006 Redzisz ..... 190/111
7,243,793 B2 * 7/2007 Ho ..... 206/373
2004/0065573 A1 * 4/2004 Brouard ..... 206/373

* cited by examiner

FIG.2
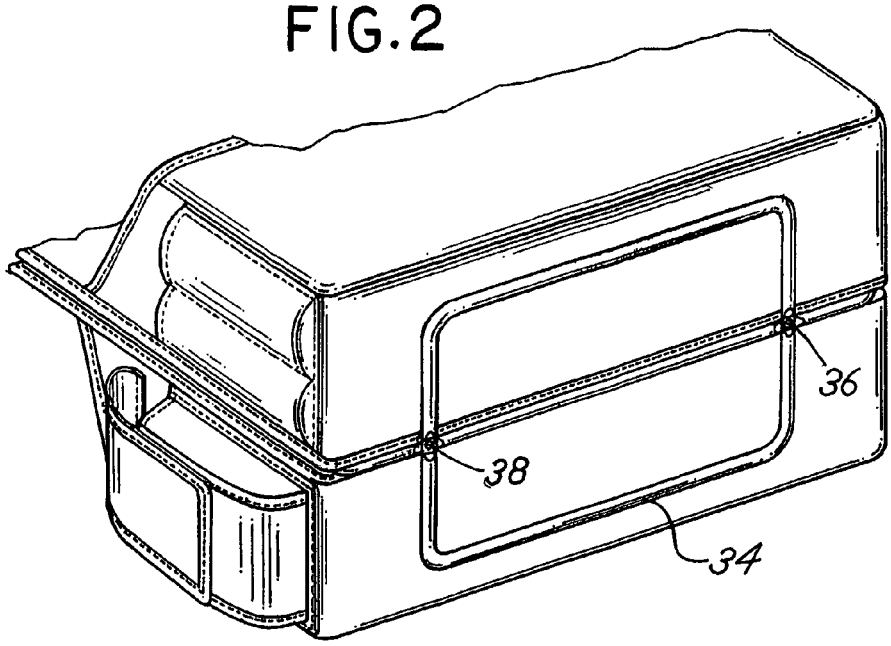
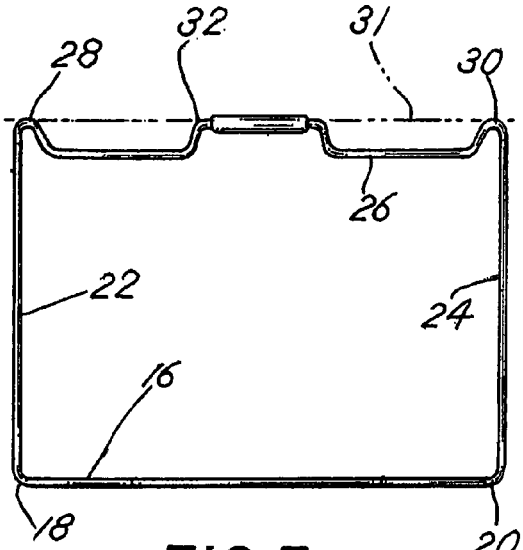
FIG.3
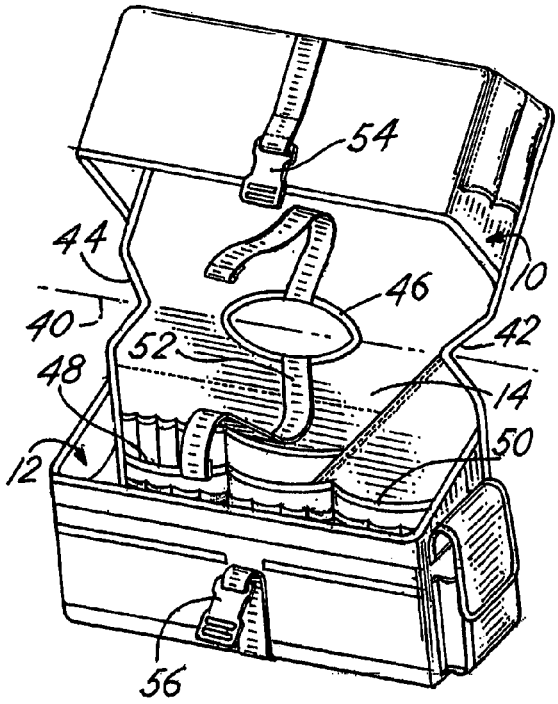
FIG.4

FIG. 5
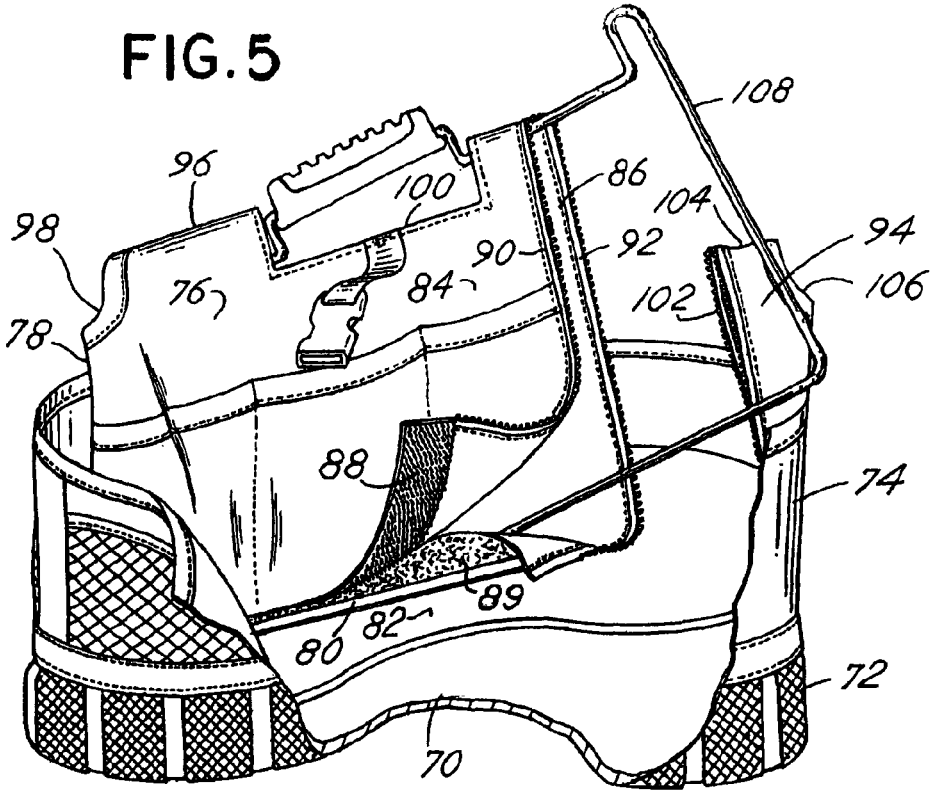
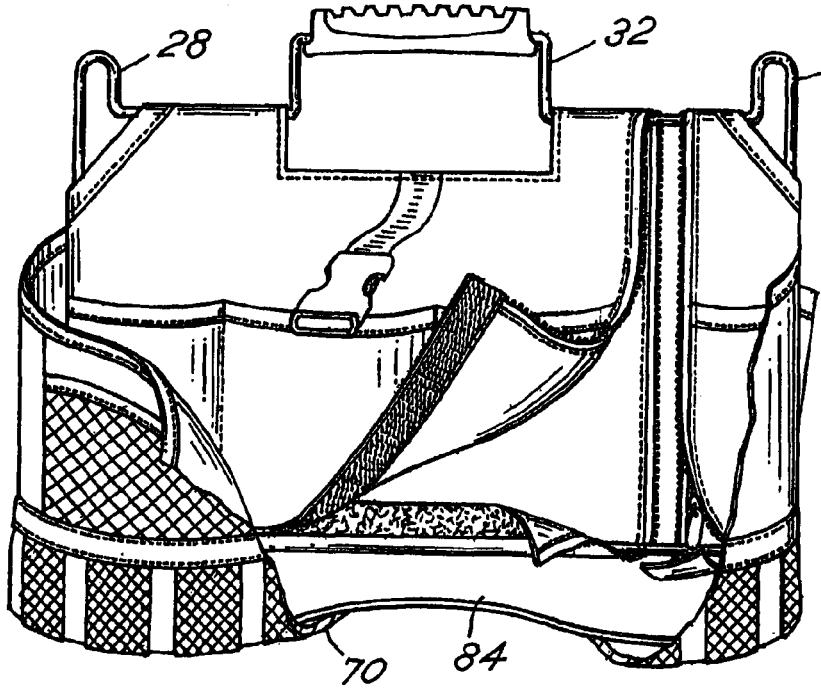
FIG. 6

252
216
212
208
218
202
232
250
214
204
206

240

240
238
202
236
204
206

248

244
204
202
246
206
219
228

208
225
221
224
220
264
266
266
223
268
220B
220A

FRAMED SOFT SIDED CARRIER FOR TOOLS

CROSS REFERENCE TO RELATED APPLICATION

This is a continuation-in-part application of Ser. No. 10/430,717 filed May 6, 2003, entitled Framed Soft Sided Carrier for Tools which is a continuation-in-part application and also a division of Ser. No. 09/838,908 filed Apr. 20, 2001, entitled "Framed, Soft Sided Carrier For Tools", now U.S. Pat. No. 6,571,998, which is a utility application and patent based upon previously filed provisional application Ser. No. 60/198,966 filed Apr. 21, 2000, each of which is incorporated herewith by reference and for which priority is claimed and of application Ser. No. 10/982,319 filed Nov. 4, 2004 entitled Tool Carrying and Storage Case, which is a continuation of Ser. No. 10/393,125 filed Mar. 20, 2003 which is based upon provisional application Ser. No. 60/365,966 filed Mar. 20, 2002 all of which are incorporated herewith by reference and for which priority is claimed.

BACKGROUND OF THE INVENTION

In a principal aspect the present invention relates to a carrier for tools and other similar articles comprised of a flexible bag and a frame which is in combination with the bag.

Tradesmen and craftsmen often find it necessary to carry multiple tools for practice of their trade. Various types of bags and containers have been developed to facilitate the transport of such tools. Often such bags or containers are fabricated from a fabric such as canvas or a vinyl material. Various designs of such containers or bags are available. Nonetheless there remains a need for improved designs and further the need for designs which are collapsible or may be folded for ease of transport and for appropriate ease of packaging in order to market the products. Additionally, there remains the need for tool bags designed to carry heavy, electrically operated tools such as drills as well as attachments and power sources for such tool in a manner which provides protection and the capability of organization of the tool parts and accessories.

SUMMARY OF THE INVENTION

Briefly, the present invention comprises a collapsible tool carrier or bag comprised of first and second principal, open top pockets with a connecting web separating the two separate, principal pockets. The web is constructed of opposed web panels that define an enclosure or slot. A wire frame is inserted in the enclosure or slot between the opposed panels. The frame includes loops that project from openings provided in top seam or the juncture between the opposed web panels. End loops in the frame are provided for a shoulder strap and a handle loop is incorporated at the middle of the frame. Various embodiments of the invention are depicted including an embodiment comprised of a flexible container having the configuration of a saddle bag, and a flexible sided container wherein the bottom of the container is rigid with a mid-panel or web pocket into which the wire frame is inserted and retained by means of a fastener such as a zipper. Other embodiments substitute rigid boards for the wire frame.

More specifically, a tool bag or carrier is disclosed having generally trapezoidal end panels connected by a bottom panel wherein the panel assembly is comprised of at least three layers of materials including inner and outer layers of fabric or flexible material which generally encapsulates a stiffening board or assembly. The end panels are joined by a fabric or flexible material dividing wall which is supported by straps attached to a rigid handle that also connects the end panels. Folding side flaps are provided to enclose the space between the end panels and thereby, in combination with the dividing wall, parse the enclosure into at least two separate compartments. Additional stiffening elements may be incorporated in the dividing wall, end panels and side flaps in preferred embodiments.

Thus it is an object of the invention to provide improved collapsible tool bag or container comprised of first and second main pockets separated by midpanel or web construction which is adapted to receive a reinforcing wire frame.

It is another object of the invention to provide a collapsible carrier bag or container which may include multiple pockets and straps to facilitate the storage and carriage of tools and items of various shapes and sizes.

Yet another object of the invention is to provide a collapsible tool bag or carrier which is economical, light weight, easy to assemble, easy to disassemble and package, and rugged.

Another object of the invention is to provide a tool bag having opposed end panels joined by a bottom panel wherein the panels are comprised of inner and outer layers of flexible fabric material encapsulating stiffening elements and wherein the spaced end panels are joined at their top side by a rigid handle which supports a dividing wall that also extends between the end panels.

A further object of the invention is to provide a ruggedly constructed tool bag which includes a frame work of generally rigid components including opposed end panels and a bottom panel wherein the end panels are connected to each other by a rigid handle which also supports a dividing wall within the enclosure defined by the panels. A further feature and object of the design is to provide flexible and attachable side flaps for the enclosure as well as an array of pockets within the enclosure for tool components and the like.

These and other objects, advantages, and features of the invention will be set forth in a detailed description which follows.

BRIEF DESCRIPTION OF THE DRAWING

In the detailed description which follows, reference will be made to the drawing comprised of the following figures:

FIG. 2 is a bottom isometric view of the tool carrier of FIG. 1;

FIG. 3 is an elevation of the wire frame which is used in the collapsible tool carrier;

FIG. 4 is an isometric view of the fabric bag which is utilized with the wire frame of FIG. 3 to provide the collapsible tool carrier of the invention; and FIG. 5 is an isometric view of an alternative embodiment of the invention;

FIG. 6 is an isometric view of the embodiment of FIG. 5 partially assembled for use;

DESCRIPTION OF THE PREFERRED EMBODIMENTS

Figure 1:
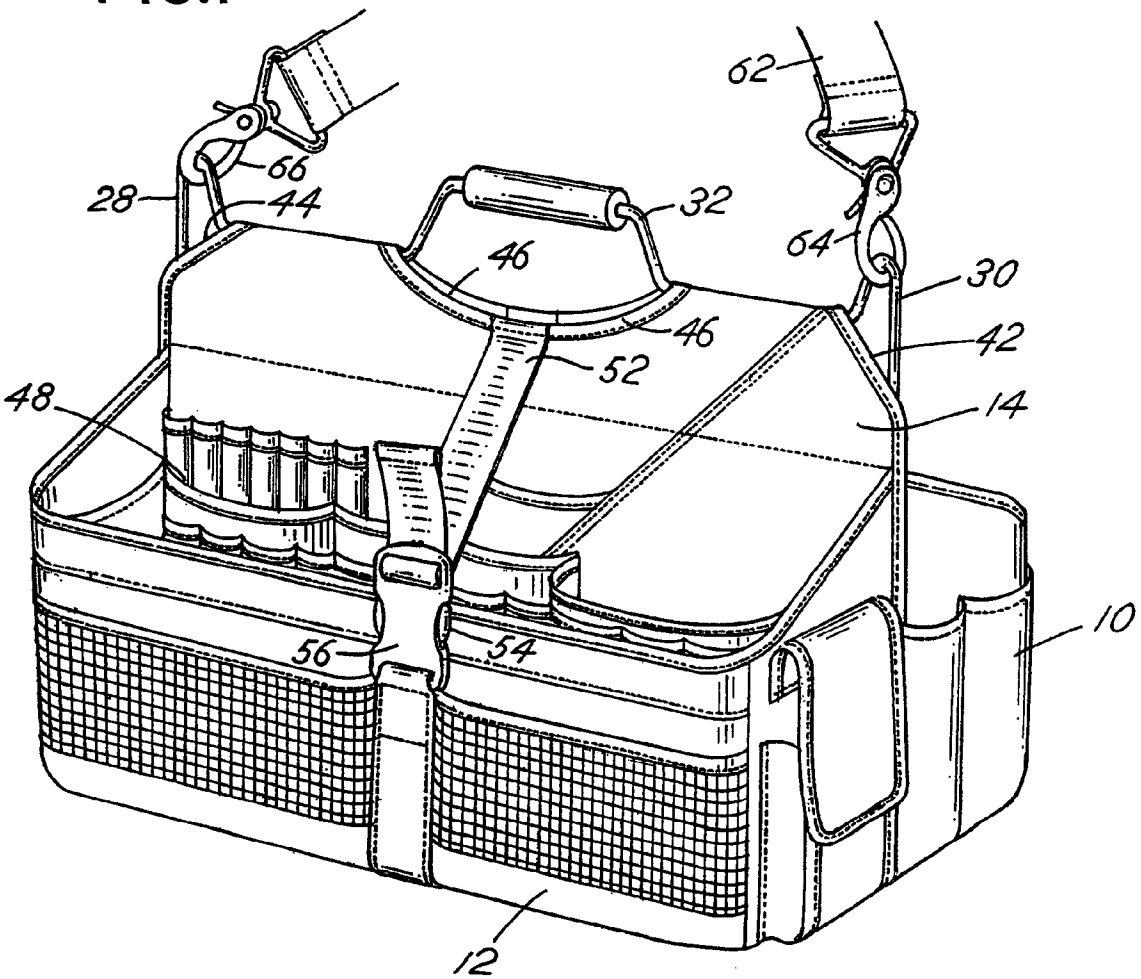
FIG. 1 is an isometric view of the assembled collapsible tool carrier of the invention.

Referring to the figures, the collapsible portable tool carrier of the invention is comprised of two basic component parts: a wire frame, such as depicted in FIG. 3 and a fabric bag having first and second separate pockets 10 and 12 and a connecting web 14 between the pockets 10, 12 as depicted in FIG. 4. The following description of a first embodiment will be directed to the wire frame to be followed by a description of the fabric bag.

The wire frame includes a straight bottom run 16 having first and second spaced ends 18 and 20. A first frame side 22 extends upwardly from the end 18. A second parallel, spaced frame side 24 extends upwardly from the end 20. The frame sides 22 and 24 are connected by a top run 26. The top run 26 includes a first end loop 28 and a second, spaced end loop 30 at the junction, respectively, of the top run 26 and the side frame run 22 and the top run 26 and the side frame run 24. A middle handle section 32 in the form of a loop is defined in the top run 26. The loops 28, 30, as well as the handle section 32 are generally aligned along a line 31 which is spaced from and parallel to the bottom run 16. An optional rectangular frame 34 is affixed to the bottom run 16 transversely thereto and connected by screws or fasteners 36 and 38.

Referring next to FIGS. 1 and 4, there is depicted in greater detail the construction of the fabric bag or carrier. The fabric bag may be constructed from a material such as canvas or the like. The bag includes a first pocket 10 and a separate second pocket 12 separated and connected by a connecting web 14. The connecting web 14 defines a middle axis 40. In a preferred embodiment of the invention, the axis 40 is an axis of symmetry of the pockets 10 and 12. The bag assembly thus has the form of a saddle bag.

The web 14 includes a first notch 42 on one side thereof and a second notch 44 on the opposite side thereof. An intermediate opening 46 is defined on the axis 40 between the notches 42 and 44. Each pocket 10, 12 may include a series of pouches or subpockets, such as subpockets 48 and 50 for holding various tools. Web 14 further includes a strap 52 attached thereto extending from opening 46 with a connector 54 which may be attached to a strap and connector 56 attached to the outside of pocket 12 to hold the tools and the pocket 12 in a supported condition. The pocket 10 has a similar symmetric construction through the arrangement and configuration of ancillary pockets or pouches may be varied.

It will be noted by referring to FIG. 1 that the web 14 is folded over the top run 26 of the frame with the handle 32 projecting through the opening 46 and the loops 28 and 30 projecting through the notches 44 and 42, respectively. A carrying strap 62 with attachment clips or latches 64 and 66 may then be attached to the loops 28 and 30 for support of the bag.

Figure 7:
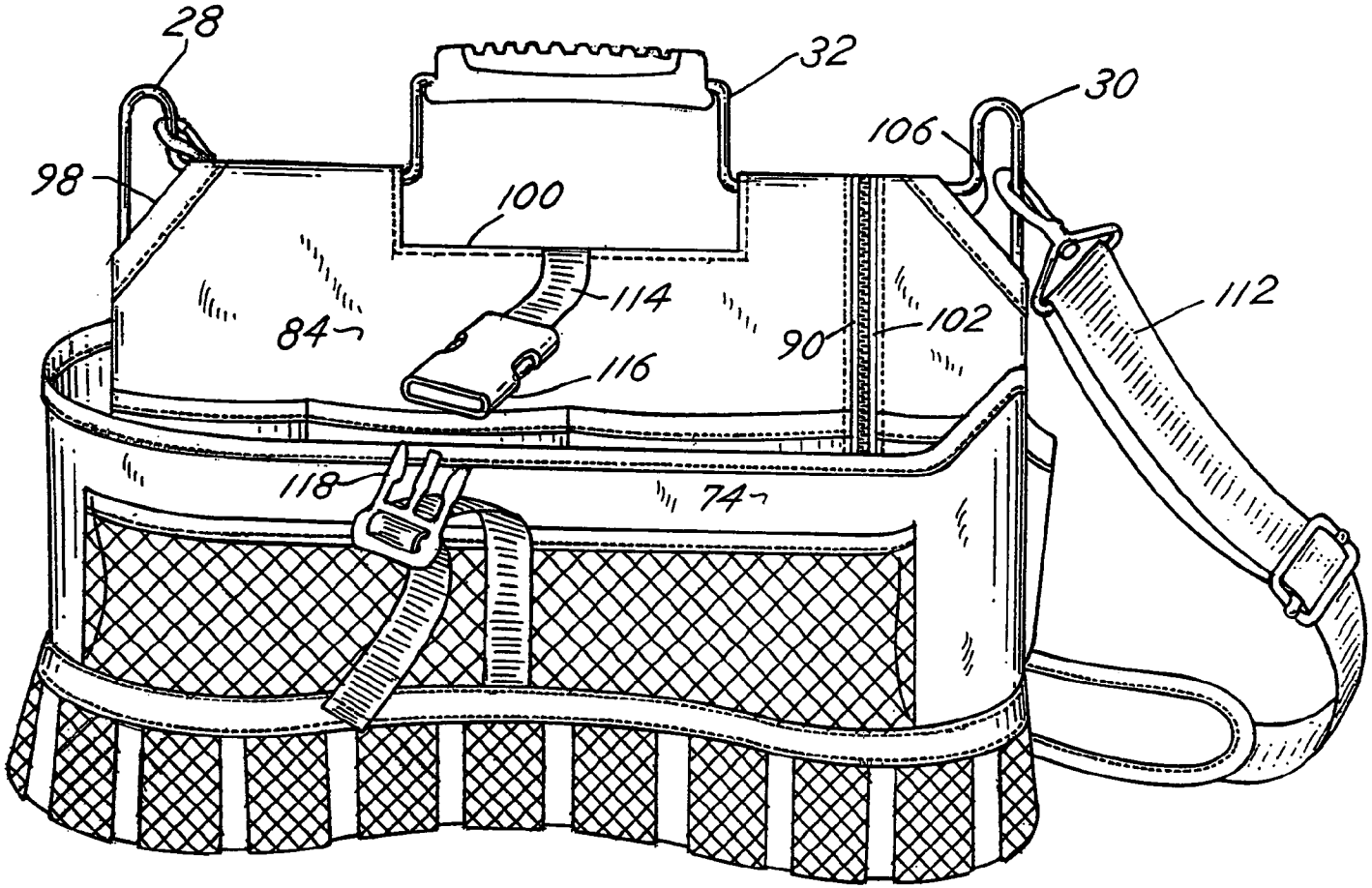
FIG. 7 is an isometric view of the embodiment of FIG. 5 fully assembled for use.

Next referring to FIGS. 5, 6 and 7 there is depicted an alternative embodiment of the invention. In this embodiment, a bottom 70 of the bag is formed from a generally rigid material such as molded rubber or plastic material. The configuration of the bag may thus be controlled or adjusted by means of the shape of the bottom 70. For example, the profile of the bottom 70 may be that of a kidney shape so that the bag may easily be carried by a worker or tradesman on his or her hip. That is, a kidney shaped bag will have a concave side which will easily fit against the hip of a worker for transport of the bag.

The bottom 70 may include peripheral, upstanding side flange 72 around the circumference of the bottom 70. Circumferential side wall 74 is attached to the flange 72 and extends upwardly to define the interior or enclosure of the bag. The side wall 74 is comprised of a flexible material such as canvas fabric or a vinyl material. Of course, pockets may be formed up of both the inside and outside of the peripheral or circumferential side wall 74.

Positioned within the interior of the enclosure defined by the side wall 74 is a central or midpanel or web 76 which substantially divides the collapsible bag into equal sized, major pockets within the enclosure defined by the side wall 74. The midpanel or web 76 includes a first edge 78 which is preferably attached to the side wall 74 on the inside thereof. Optionally, the web 76 includes a bottom edge 80 which is attached to a rigid planar insert 82 attachable to the inside surface of bottom 70. The insert 82 may be lifted or detached from the bottom 70. The web 76 includes a first sheet or panel 84 and a separate sheet or panel 86, a fastener 88, such as a Velcro fastener, is provided along the lower edge 80 for coaction with a fastener 89 to enclose the tubular enclosure defined by the separate sheets or panels 84 and 86.

The separate sheets 84 and 86 each include a second or inside edge or side 90 and 92, respectively. The edges 90 and 92 may be joined or attached to a midplane web extension 94. The tubular enclosure defined by the panels 84 and 86 further includes a top edge 96 having cut out openings 98, 100 therein. The cut out opening 100 is substantially at the midpoint of the distance between the sides of the enclosure wall or panel 74.

The panel web extension 94 comprises a tubular member, or in other words compatible side sheets or panels to web 76 and a zipper fastener 102 along an edge thereof cooperative with the zipper fastener 90, 92 of the midpanel web 76. The web extension 94 further includes a top edge 104 with an open passageway or opening 106.

A frame 108 having a construction similar to the frame depicted in FIG. 3 is provided to fit within the tube enclosure defined by the panels 84 and 86 and the web extension 94. Thus the zipper connection 90, 92, 102 is first disconnected. The frame 108 is then inserted in the tube of web 76 and extension 94 and fitted in the manner depicted in FIG. 6 so that the end loop 28, 30 as well as the handle 32 are fitted through the appropriate openings 98, 100, and 106. The zipper connection 90, 92, 102 is closed thereby encompassing the frame 108. The insert or base 82 may then be fastened to bottom 70.

A carry strap 112 may be attached to the loops 28, 30. A pocket retention strap 114 fixed to the web 84 includes a fastener 116 connectible with a fastener 118 attached to the side panel 74. This is a strap construction similar to the first embodiment previously described.

Both the first and second embodiments may thus be easily assembled or disassembled. For the second embodiment of FIGS. 5 and 6, removal of the frame 108 by detaching or unfastening the zipper 90, 92, 102 and removing the fasteners 88, 90 will permit the removal of the frame 108. In this manner, the entire assembly and more particularly the peripheral side wall 74 may be folded with the midpanel or connecting web 76 into a flat condition and placed in a packing box for display. Thus the assembly provides a rigid shaped tool carrier bag when assembled yet on the other hand may be disassembled for ease of packaging, storage, etc.

Figure 8:
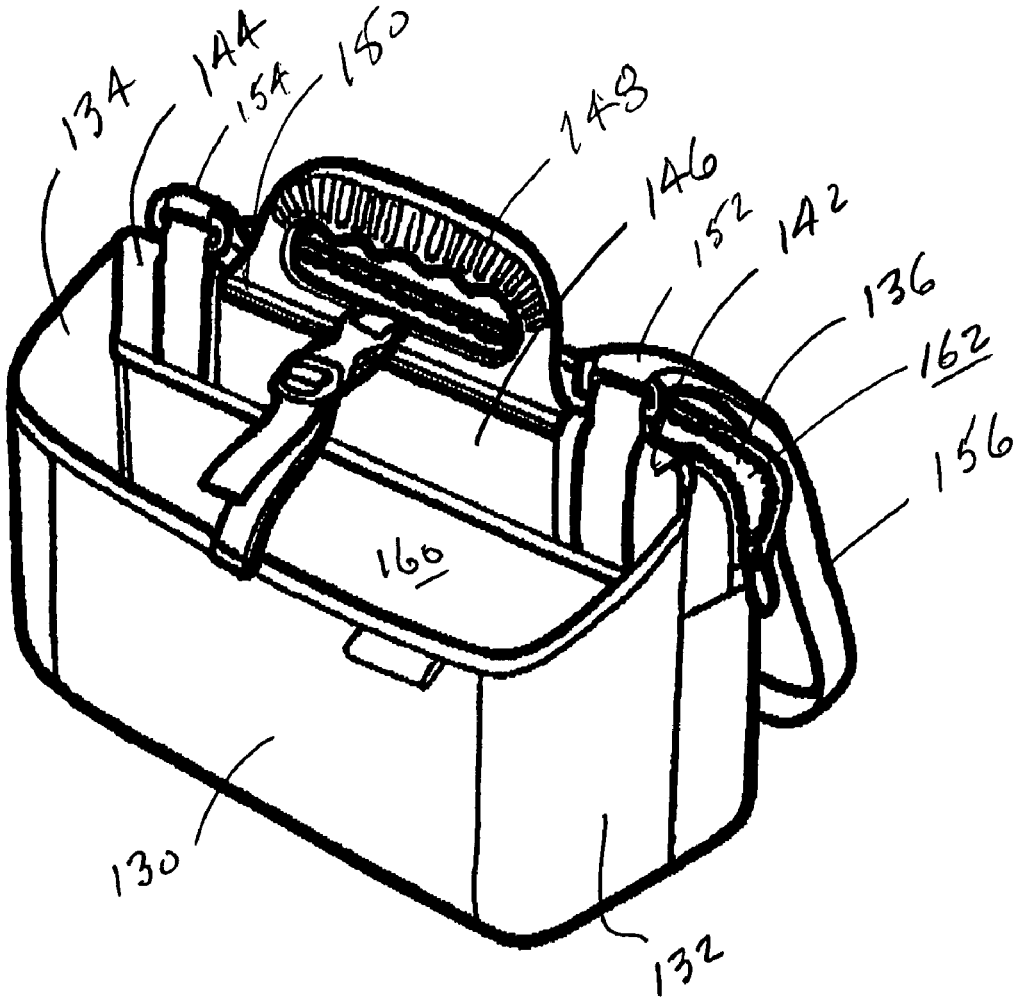
FIG. 8 is an isometric view of a further alternative embodiment of the invention utilizing a rigid plastic internal frame member.
Figure 9:
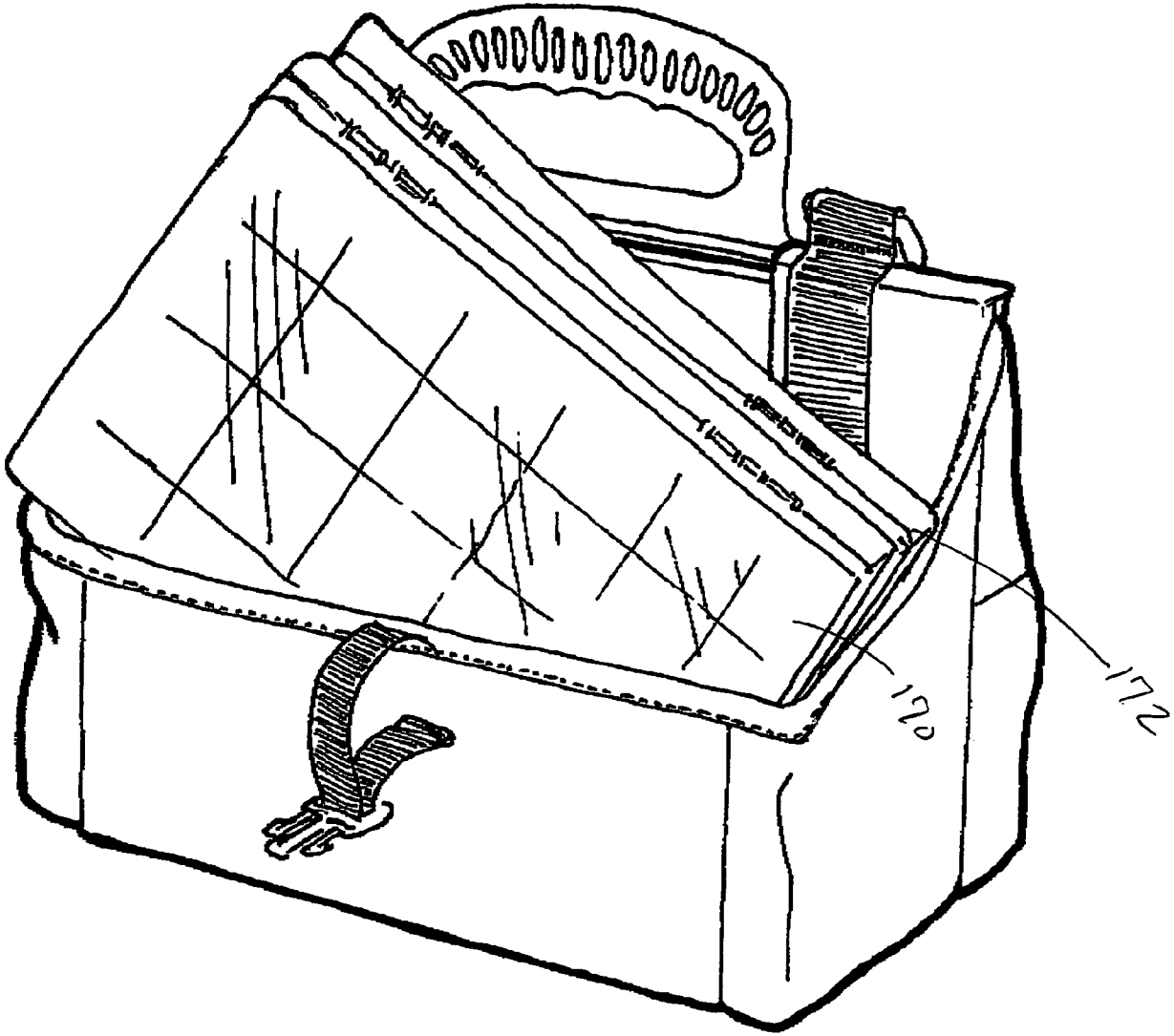
FIG. 9 is an isometric view of an embodiment of the type shown in FIG. 8 further including modular sized, separate molded plastic containers incorporated in combination with the carrier.
Figure 10:
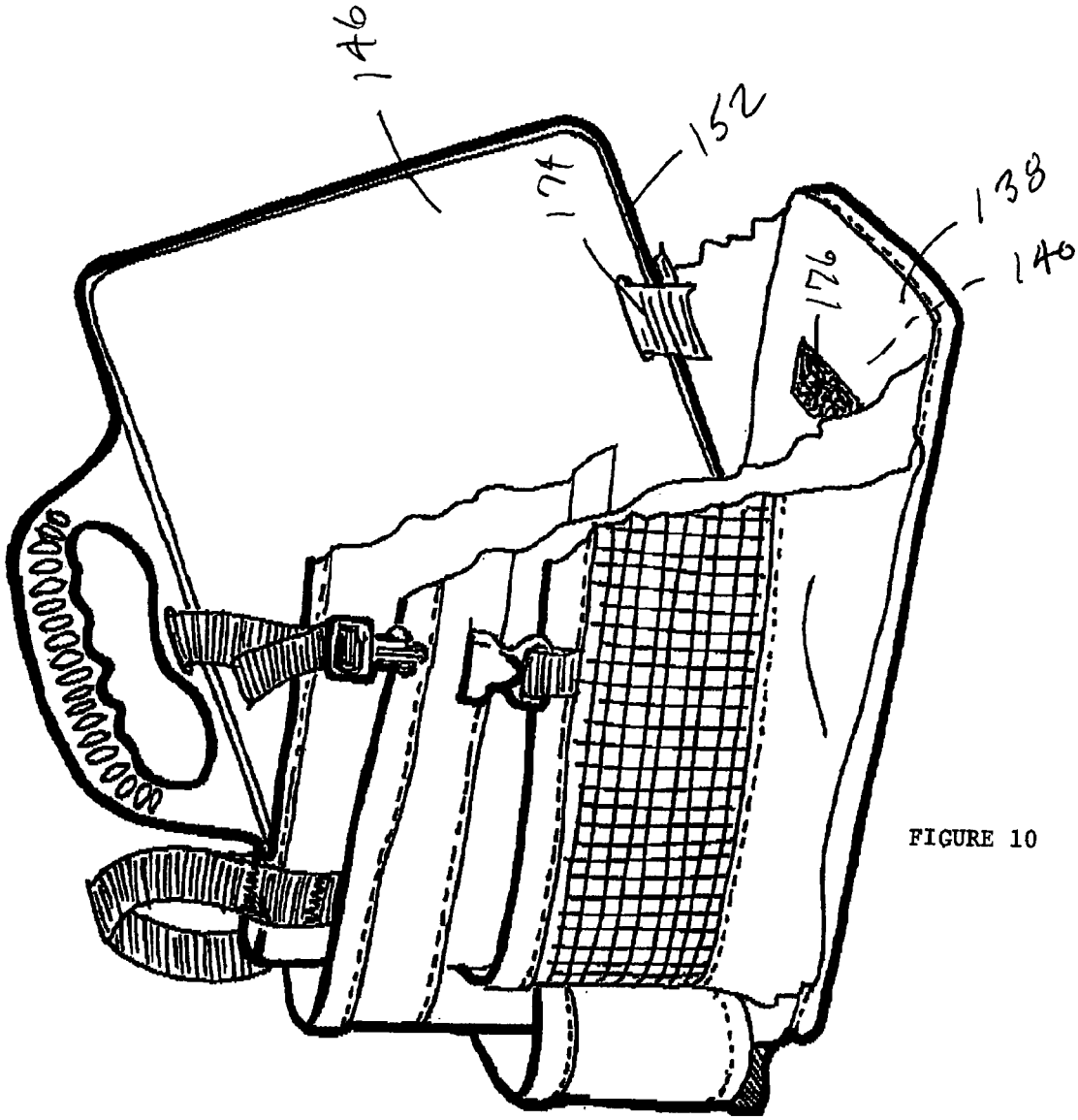
FIG. 10 is an isometric view of the embodiment of FIG. 8 partially cut away and sectioned to reveal the construction of the carrier.

FIGS. 8-10 illustrate, in general, another alternative embodiment of the invention. In this alternative embodiment, the carrier includes a flexible fabric material front wall 130, a first flexible fabric lateral or side wall 132 and a second flexible fabric lateral or side wall 134 generally parallel to and spaced from the first flexible fabric side wall 132. The carrier further includes a flexible fabric back side wall 136 generally parallel to and spaced from the front or forward flexible fabric wall 130. A bottom wall, for example, bottom wall 138 in FIG. 10 is also included as a component part of the carrier. The bottom wall 138 may be formed from a flexible fabric material as are the other walls. Alternatively, the bottom wall 138 may comprise a flexible fabric material with a rigid board, for example, a board member 140 encapsulated or sewn into a flexible fabric material as depicted, for example, in FIG. 10. Alternatively, the bottom wall 138 may be a flexible fabric material with a board rested thereon. Yet a further alternative is depicted in FIGS. 5-7 wherein the bottom wall comprises a rigid molded material wall as previously described.

In any event, the carrier includes a mid-panel comprised of a first major pocket 142 and a second, opposed major pocket 144. The pockets 142 and 144 are positioned on a plane which constitutes a mid plane halfway between the flexible front wall panel 130 and the flexible back wall panel 136 generally parallel thereto and spaced equally from the respective panel walls 130, 136. The pockets 142 and 144 each comprise flexible fabric material which is sewn into the lateral side walls 132 and 134 with openings exposed or directed toward one another so that a rigid board 146 or wire frame may be inserted into the pockets 142 and 144 thereby providing structural integrity to the carrier. The rigid board 146 may be of molded plastic material with a molded handle 148 along an upper margin 150. A lower margin 152 will then be adjacent the bottom wall 138 as depicted in FIG. 10. The board 46 may be a molded plastic panel or fabricated from a wire material or a rod material, and thus be in the form of a wire frame, such as the embodiments depicted in FIGS. 1-4. The pockets 142 and 146 may include a strap 152 and 154 sewn thereto and connected to a shoulder strap 156, for example. The construction therefore provides a first compartment 160 adjacent the front wall 130 and a second compartment 162 adjacent the back wall 136. The compartments 160 and 162 are generally equal in size. They are also preferably accessible from the top of the carrier and may, or may not, include top flaps or covers enclosing the compartments. Thus, the carrier, when filled with items, will facilitate the balance thereof.

The compartments 160 and 162 may receive, by way of example, modular molded storage boxes 170 and 172. In such an embodiment, the storage boxes 170 and 172 may, for example, be fishing tackle boxes which are maintained within the compartments 160 and/or 162, as depicted in FIG. 9.

FIG. 10 illustrates one of the alternative constructions for attaching a board member or frame member 146 to bottom wall 138. Hook and eyelet tabs 174 associated with the lower margin 152 of the frame member 146 engage hook and/or eyelet members 176 (e.g. Velcro fasteners) associated with the bottom wall, or bottom panel 138. This enables attachment of the rigid frame member 146 to the bottom wall 138, the frame member also being held by virtue of the pockets 142 and 144 as previously described.

Figure 11:
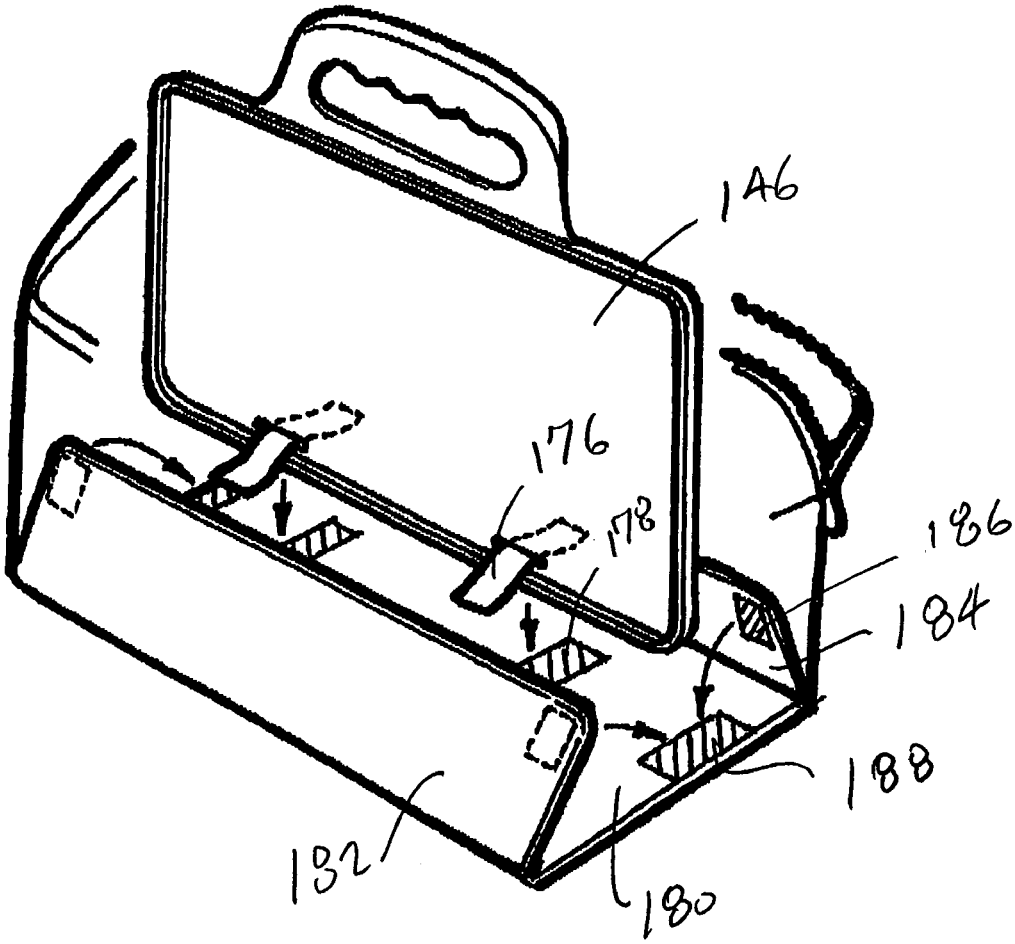
FIG. 11 is an isometric view of an alternative frame construction utilized in the fabrication of an embodiment of the type depicted in FIG. 8.

FIG. 11 illustrates another alternative construction wherein frame member 146 includes hook and eyelet tabs 176 which engage with tabs 178. This arrangement facilitates holding the frame member 146 in position. FIG. 11 illustrates the further feature of providing a board 180 for use in combination with, or as part of, the bottom wall 138 wherein the board 180 includes articulating side panels 182 and 184 which include hook and eyelet fastening elements 186, by way of example, which engage with hook and/or eyelet fastening elements 188 on the bottom panel 180. Each of the panels 180, 182 and 184 are generally rigid panels. The panels 182 and 184 are one half or semi-sized with respect to the bottom panel 180 thus define a means for positioning the frame member with the carrier and provide a rigid bottom wall construction in combination with a rigid, vertical frame member 146, again, which may be used in combination with the flexible fabric walls previously described.

Figure 12:
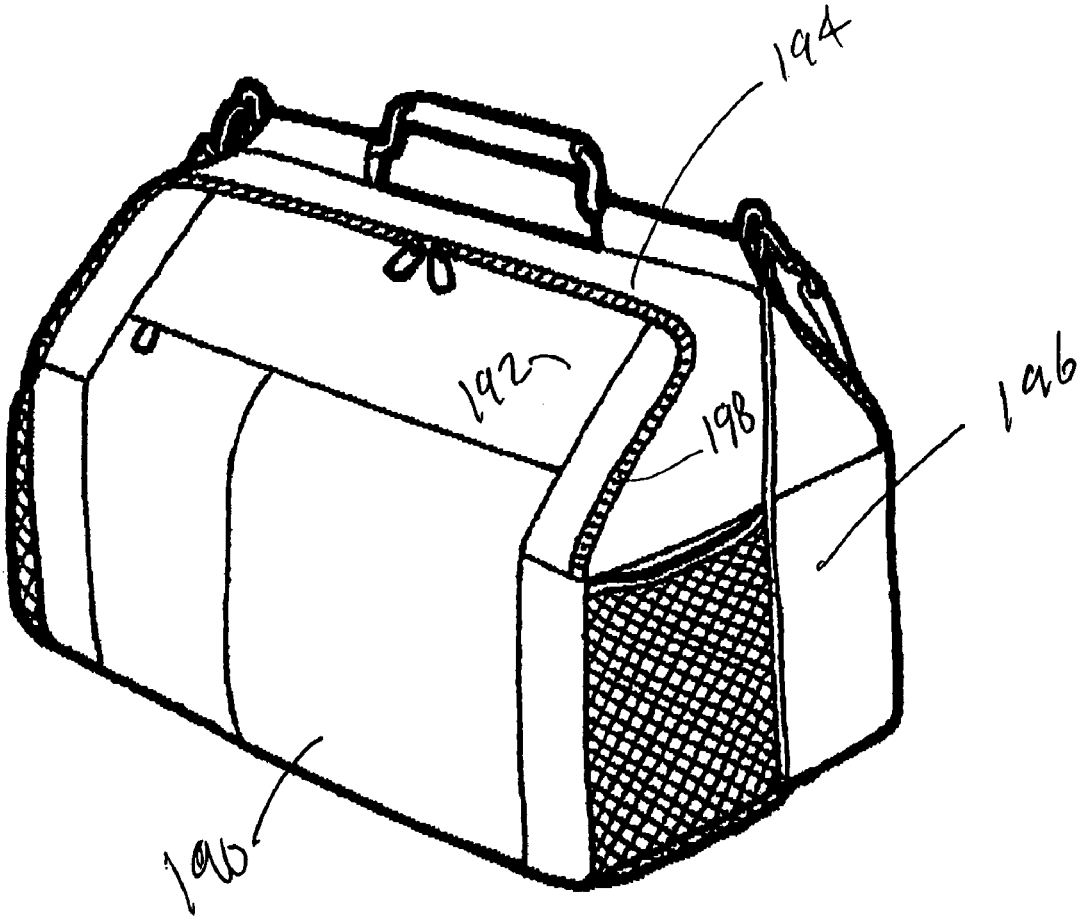
FIG. 12 is an isometric view of an embodiment of the invention utilizing insulated, flexible, fabric walls to provide a carrier which can serve as a cooler or insulated bag.

FIG. 12 illustrates that the flexible bag or wall material used for the carrier may include insulated or padded fabric walls. For example, a front wall 190 made from a flexible insulated fabric material will include an upper margin or flap 192 which connects with a closure flap 194 incorporated as an extension of a lateral side wall 196. A zipper enables detachment of the flap 192 from the extension section 194 for access to the interior of the carrier depicted in FIG. 12. Thus, the overall combination of elements lends itself to multiple variations and uses including the use as an insulated carrier as depicted in FIG. 12.

Figure 18:
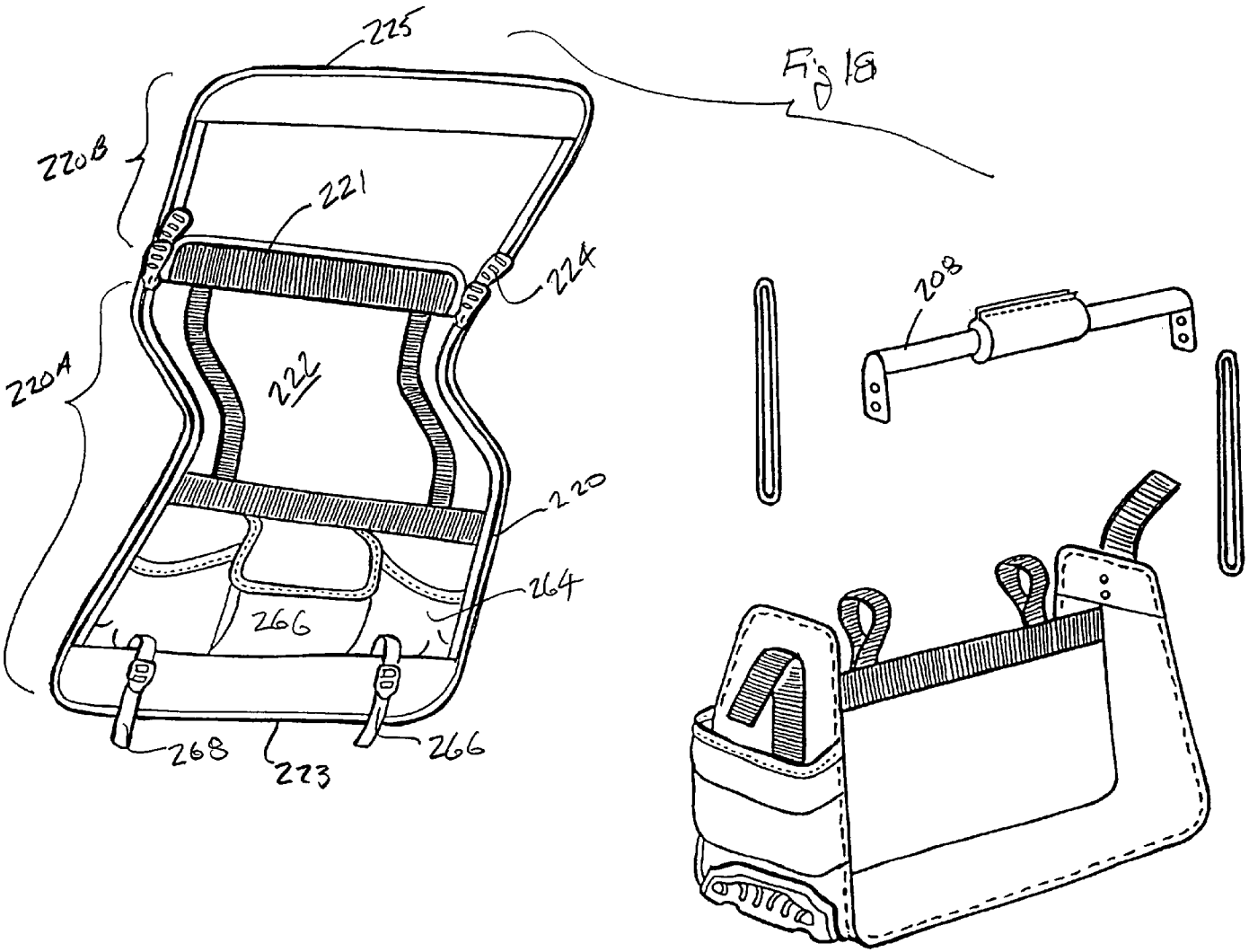
FIG. 18 is an exploded, isometric view of the component parts of the construction of FIG. 13.
Figure 22:
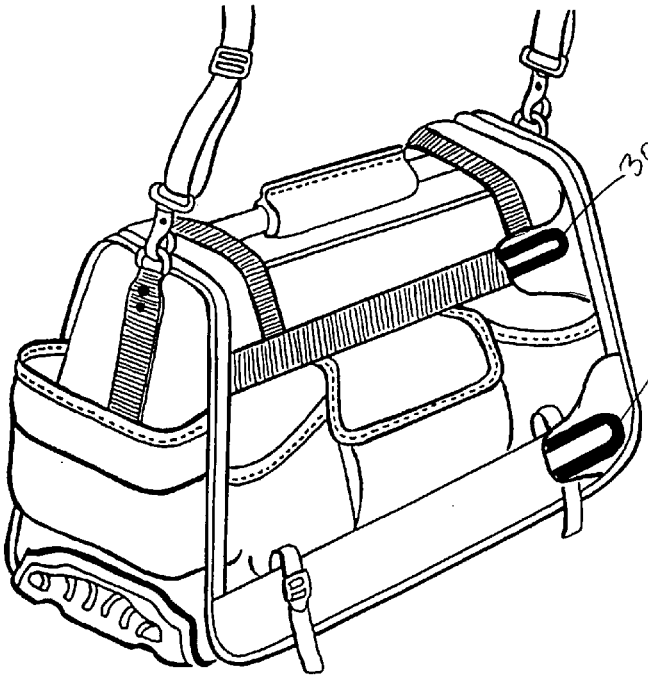
FIG. 22 is an isometric view of the tool bag of FIG. 21 wherein the cover flap is in a closed position and is partially cut away to reveal additional stiffening elements.
Figure 19:
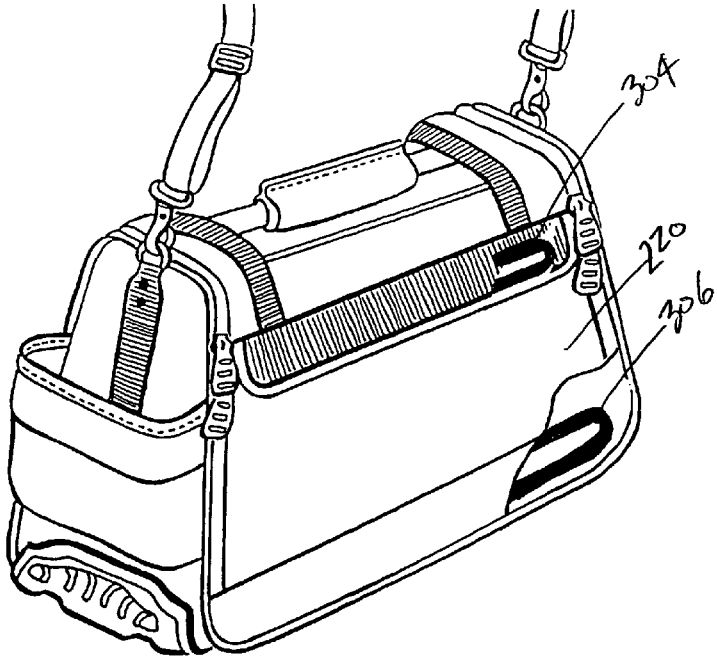
FIG. 19 is an isometric view of the bag of FIG. 13 illustrating additional reinforcing elements in a partial cut away isometric view.
Figure 20:
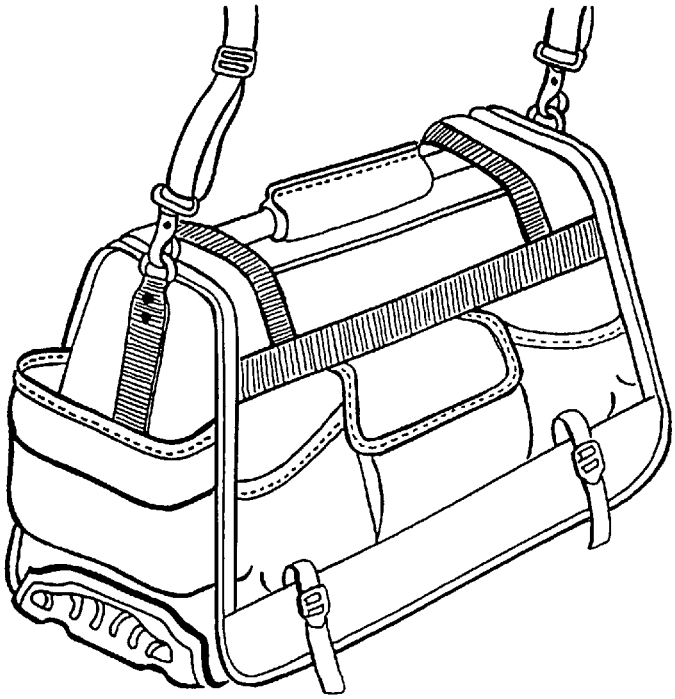
FIG. 20 is an alternative embodiment to the bag of FIG. 13.
Figure 21:
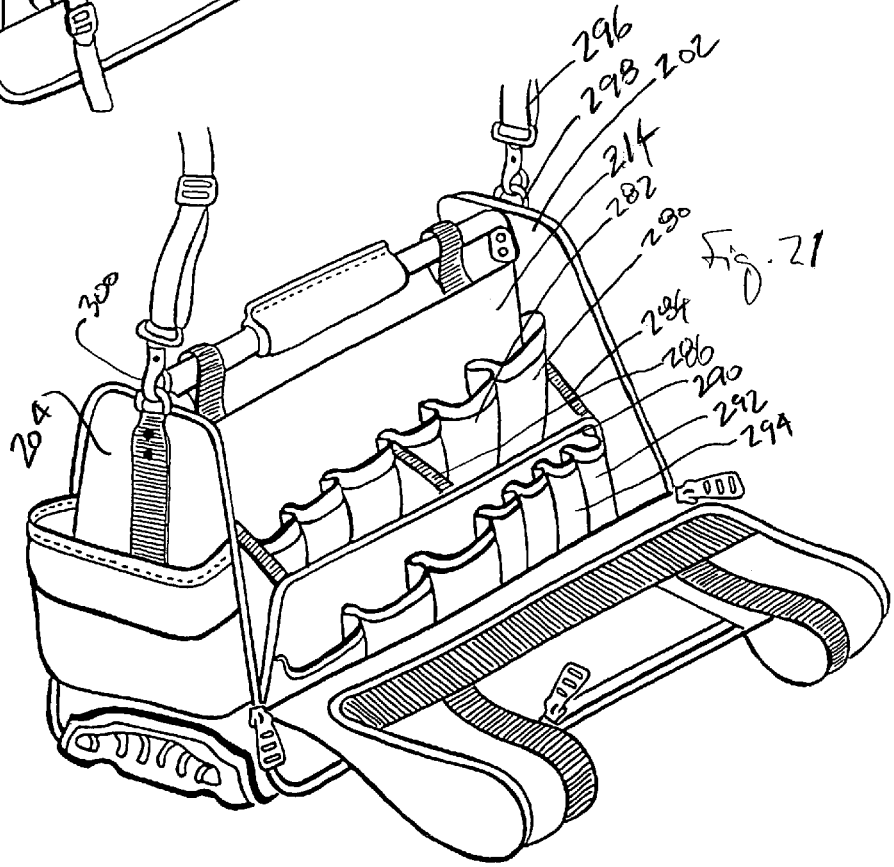
FIG. 21 is an isometric view of the bag of FIG. 21 wherein the cover flap associated with the bag has been opened.

FIGS. 13-22 illustrate, in general, an alternative construction of the invention. More specifically, FIGS. 13-19 illustrate a first version of this alternative construction. FIGS. 20-22 illustrate a second version of the alternative embodiment.

Thus referring first to FIGS. 13-20, Heavy Duty Tool Bag 200 includes a first end panel 202 have a generally trapezoidal shape and an opposed congruent shape second end panel 204 spaced from the first end panel 202 by a connecting generally rigid bottom panel 206. The generally trapezoidally shaped opposed first and second end panels 202 and 204 are connected to one another by means of a rigid, tubular handle 208. The rigid, tubular handle 208 is connected by rivets 210 to the respective opposite end panels 202 and 204. In a preferred embodiment, the handle 208 is a stiff tubular member formed, for example, from extruded aluminum and further includes a center handle grip section 212. Preferably, the construction of the component parts is undertaken so as to provide a generally symmetrical arrangement of the component parts so that when a tradesman grips the handle grip 212 the assembly will be easily balanced. Thus, the handle 208 will be aligned generally with a vertical centerline of the trapezoidal end panels 202 and 204. It should be noted that the end panels 202 and 204, while preferably generally trapezoidal in shape, may be varied in shape and still accommodate the features of the invention.

Figure 16:
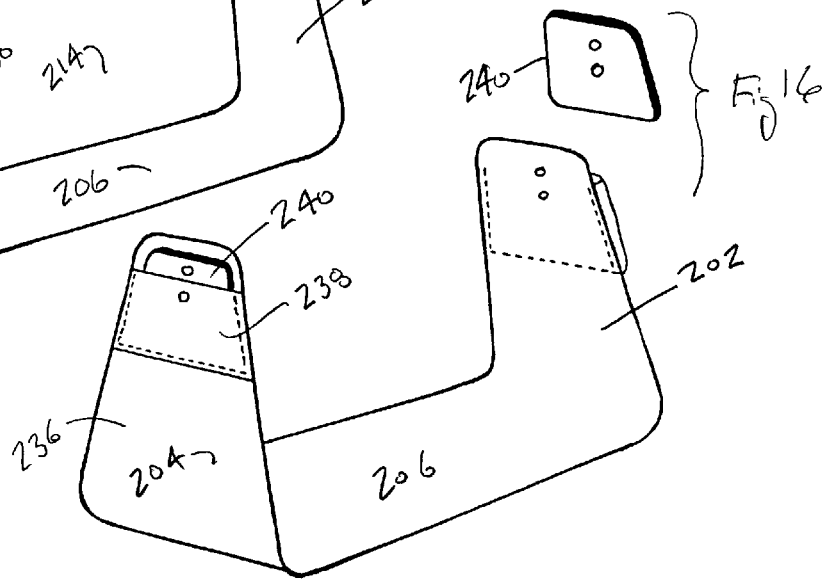
FIG. 16 is an isometric view of a portion of the construction of the bag of FIG. 13.

A generally flexible dividing wall 214 is joined typically by stitching to the end panels 202 and 204 as well as the bottom panel 206, for example, as depicted generally in FIG. 16. Further, the generally flexible material dividing wall 214 includes along its top edge a first support strap 216 and a second support strap 218. The straps 216 and 218 fit over the tubular member 208 and thereby support the dividing wall 214 and maintain that wall substantially in a planar rigid configuration to divide or parse the interior of the enclosure defined by the various panels and walls into two separate sections for the storage and carrying of tools of the like.

Figure 13:
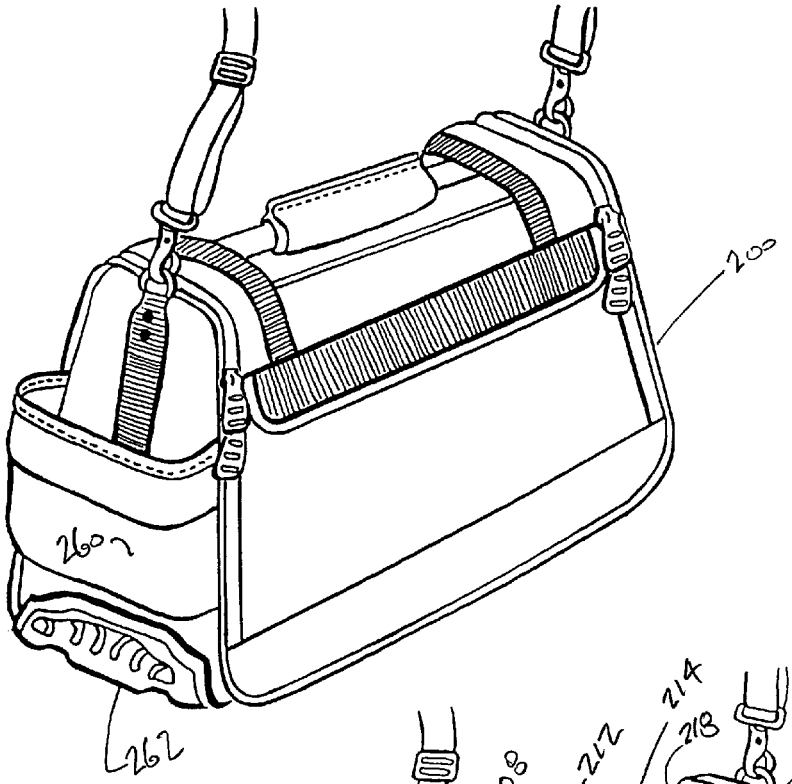
FIG. 13 is an isometric view of an alternative embodiment of the invention wherein a tool bag is depicted with the bag in the closed position or condition.
Figure 14:
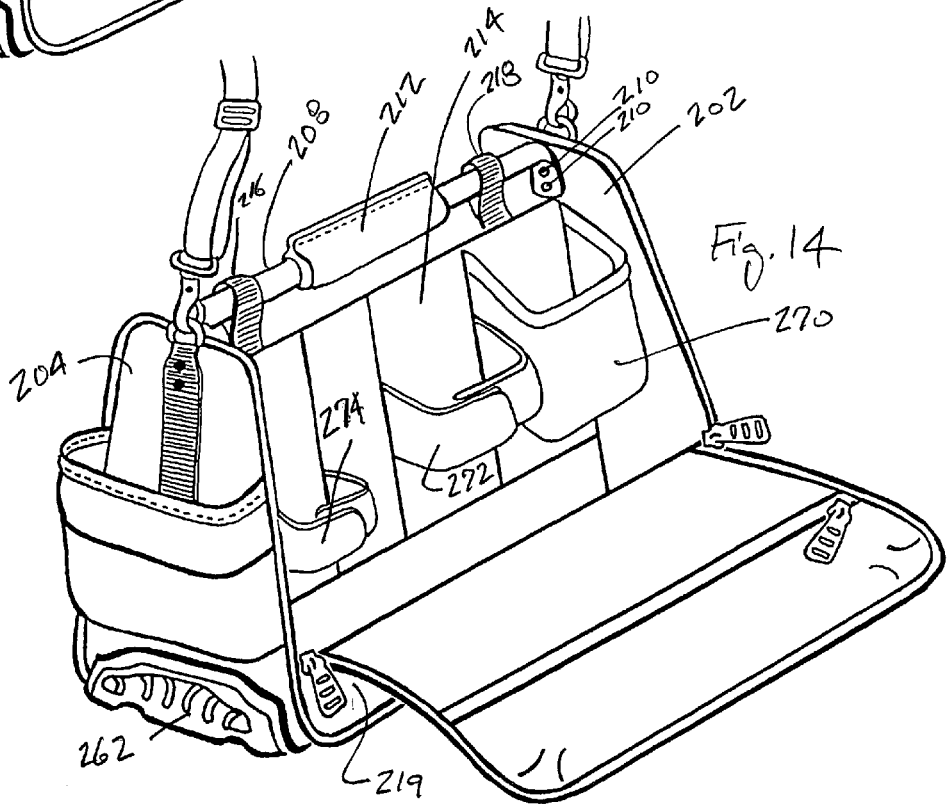
FIG. 14 is an isometric view of the bag of FIG. 13 wherein the bag has been opened to reveal the interior construction.
Figure 15:
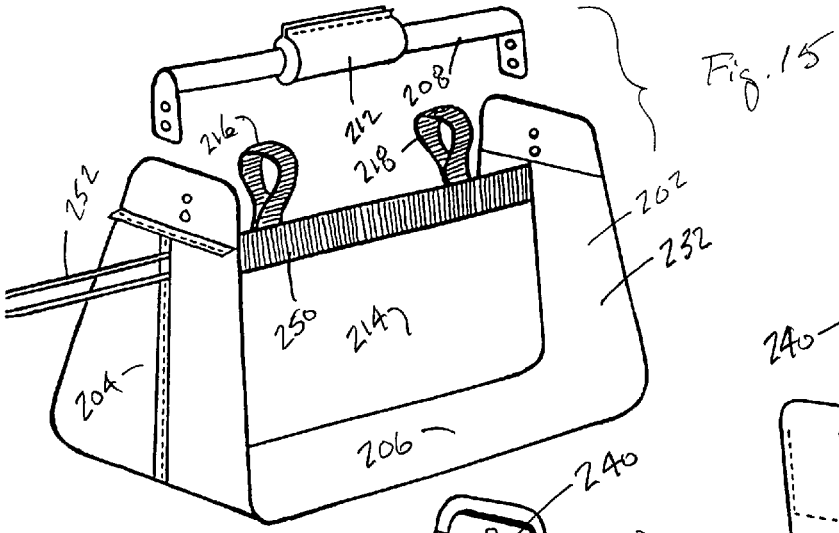
FIG. 15 is an isometric, exploded view of the portion of the construction of the bag of FIG. 13.

In a preferred embodiment of the invention the assembly of the end walls 202 and 204 or end panels 202 and 204 with the bottom panel 206 in combination with the handle member or handle 208 are further assembled with a lateral side flap construction such as depicted in FIG. 19 as the side flap construction 220. This side flap construction is joined to the bottom panel 206 along at least one edge of the side flap 220 and fits over the entire handle 208, for example, as depicted in FIG. 13. Thus, the side flap construction 220 includes a center passage or opening 222 which enables the sides flap 220 to be fitted over the entire side arrangement of the assembly defined by the end panels 202 and 204 as well as the bottom panel 206 and handle 208. A zipper construction 224 may be utilized to attach the flap 220 around a portion of or around its entire periphery to the assembly of end panels 202, 204, bottom panel 206 and rigid handle 208. Alternatively, the side flap 220 may be rigidly attached along an edge, for example, along edge 228 of the bottom panel 206. Then the zipper 224 will be provided to connect the periphery of the panel or flap 220 to the associated edges of the tool bag construction.

Figure 17:
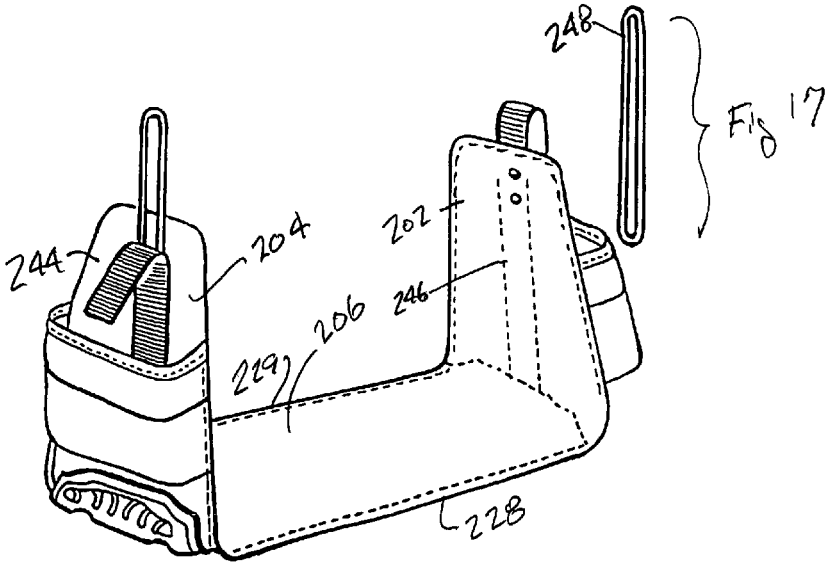
FIG. 17 is a further isometric view of a portion of the construction of the bag of FIG. 13.

In a preferred embodiment of the invention the end panels 202 and 204 and bottom panel 206 are constructed as a multiple layer construction. That is, in a preferred embodiment the construction is comprised of a first or inner layer of flexible fabric material 232 defining end panels 202 and 204 as well as bottom panel 206. The flexible fabric material is fitted over a generally stiffening board such as a polyethylene board member 236 as depicted in FIG. 17 having a generally U-shaped configuration and further including in a preferred embodiment a pocket or recess 238 on each side of the U-shaped panel for receipt of a stiffening board 240 such as a fiber board, e.g. Masonite stiffening board. This construction, depicted in FIG. 17, is then further encapsulated in a generally flexible fabric material 244 as depicted in FIG. 18 so that the board 236 and construction of FIG. 17 is generally capsulated in a flexible fabric envelop defined by an inner layer 232 and outer layer 244. In a preferred embodiment a pocket 246 is further formed between the fabric layers 232 and 234 for receipt of a stiffening element 248 to further rigidify the construction. Alternatively, the polyethylene board stiffening element 236 may be provided only along the bottom panel 206 and the stiffening element, such as the stiffening element 248, may be substituted for the vertically extending, trapezoidally shaped section defining the panels 202 and 204 in FIG. 17. In any event, in the preferred embodiment multiple layers of fabric and stiffening materials are utilized to define a generally stiffened U-shape construction forming end panels 204 and 202 as well as a bottom panel 206 with a connecting stiffening bar or handle 208 and a dividing wall 214. These components define a general construction of the tool bag of the invention and in combination with a flap construction, such as flap 220, define the enclosures for the tool bag for the invention.

As a further option, the center or diving wall 214 may include a pocket 250 which will receive a stiffening element such as a wire rod 252 as depicted in FIG. 16 to facilitate stiffening of the dividing wall 214. Further, it is to be noted that the dividing wall 214 may, and preferably is, aligned with the center of the end panels 202 and 204 again to provide for a generally symmetrical set of compartments within the enclosure defined by the construct. FIG. 19 exemplifies the assembly of all the component parts including the various stiffening elements.

There are two versions of the embodiment of the invention described. In particular, referring to FIGS. 13-19 there is depicted the first version which includes external pockets, such as the pocket 260, and a boot or reinforcing element along the bottom side of the tool bag; namely, the molded rubber or plastic element 262 in FIG. 13 and other figures. The flap 220 of the first version as depicted in FIG. 19, by way of example, in addition to including a center opening may include pockets such as pocket 264 and pocket 266 for storage of items. Further, straps such as straps 266 and 268 may be included for the purpose of holding tools attached to the side of the bag.

FIGS. 13-19 depict, in the first version of the bag, a bag interior which includes certain attachments associated with or attached to the dividing wall 214. For example, a pocket 270 is affixed to the dividing wall. Clamping arms 272 and 274 are provided for holding tools such as a drill or the like.

The second version or embodiment of FIGS. 20-22 includes some additional features such as the dividing wall 214 having a series of pockets such as pockets 280, 282 etc. affixed thereto. Flexible straps such as 284 and 286 attach to a second semi-stiff panel 290 to which additional pockets such as pockets 292 and 294 are attached. The flexible straps define an opening or space between the sets of pockets 280, 282 and the panel 290 for storage of items. A shoulder carry strap 296 is attached by means of a buckle assembly 298 to the panel 202. The adjustable shoulder strap 296 has its opposite end attached by means of a buckle assembly 300 to the panel 204.

Each of the versions of the embodiment may include additional stiffening elements associated with the flap 220. For example, referring to FIG. 19 referring to the first version a stiffening element comprising a wire loop 304 is incorporated in the flap 220 along the edge thereof defining the opening 222. The second stiffening element 306 is incorporated in an integral internal pocket along the lower edge of the flap 220. A similar construction is provided for the second version of the tool bag of the depicted embodiment as shown in FIG. 22.

As depicted in the figures, the collapsible fabric bag and other tool bag embodiments may include pockets of various size and description for holding various types of tools. Sub-pockets or pouches may be positioned on the outside of the collapsible bag or inside the bag. Thus, while there has been set forth a preferred embodiment of the invention, it is to be understood that the invention is to be limited only by the following claims and equivalents thereof.

What is claimed is:

1. A tool bag comprising:

a bottom panel including an assembly of an inner layer of flexible material covering an intermediate layer of generally rigid material, in turn, covered by an outer layer of flexible material, said bottom panel having parallel, spaced first and second lateral sides and third and fourth opposite end sides joining the lateral sides, said intermediate layer generally encapsulated between the inner and outer layers;

first and second spaced, generally parallel upstanding, generally congruently sized and shaped end panels, said first and second end panels flexibly hinged to and joining the respective third and fourth opposite end sides of the bottom panel to provide an open top for the bag, each of said end panels including a top margin;

a rigid, elongate handle member;

said first and second end panels directly connected to and joined by said rigid handle member connecting the top margin of the spaced end panels, said handle member positioned generally over the bottom panel and aligned generally parallel to and intermediate the first and second lateral sides of the bottom panel;

a flexible material dividing wall upstanding from the bottom panel generally parallel to and intermediate the lateral sides and joined to the end panels and to the bottom panel intermediate the lateral sides to parse the area formed by the bottom panel between the first and second end panels into first and second substantially equal subspaces, said dividing wall including a top margin, said dividing wall generally aligned with said handle member and openly spaced from the handle member;

first and second separate, spaced loop elements each of said loop elements separately looped over the handle member and including opposite ends connected to the top margin of said dividing wall to support the dividing wall openly spaced beneath the handle member;

said handle member including a hand grip intermediate said first and second loop elements said loop elements supporting said dividing wall spaced from and beneath the handle member and said hand grip;

a first flexible material side panel with a bottom edge flexibly joined to the first lateral side of the bottom panel, said first side panel including lateral side edges joined respectively by detachable fasteners respectively to the first and second end panels;

a second flexible material side panel with a bottom edge flexibly joined to the second lateral side of the bottom panel, said second side panel including lateral side edges joined respectively by detachable fasteners respectively to the first and second end panels;

said end panels, side panels and bottom panel thereby forming said tool bag with an open top wherein the side panels may be detached from the respective end panels to expose the interior of the bag and contents thereof in the first and second subspaces respectively said subspaces maintained with an open access top when said side panels are attached to said end panels.

2. The tool bag of claim 1 further including a supplemental stiffening element positioned within at least one end panel.

3. The tool bag of claim 2 wherein said stiffening element comprises a wire rod inserted into a pocket in an end panel.

4. The bag of claim 1 further including a carry strap attached to the first and second end panels.

* * * * *